US010520166B2

(12) United States Patent
Chan

(10) Patent No.: US 10,520,166 B2
(45) Date of Patent: Dec. 31, 2019

(54) FLASHLIGHT UNIT

(71) Applicant: Germain Electronic Limited, Hong Kong (CN)

(72) Inventor: Siu Heng Louie Chan, Hong Kong (CN)

(73) Assignee: GERMAIN ELECTRONIC LIMITED, Hong Kong (CN)

( * ) Notice: Subject to any disclaimer, the term of this patent is extended or adjusted under 35 U.S.C. 154(b) by 0 days.

(21) Appl. No.: 15/818,926

(22) Filed: Nov. 21, 2017

(65) Prior Publication Data

US 2018/0195697 A1 Jul. 12, 2018

(30) Foreign Application Priority Data

Jan. 6, 2017 (CN) ..... 2017 2 0015349 U
Jul. 5, 2017 (HK) ..... 17106735

(51) Int. Cl.

| | |
|---|---|
| ***F21L 4/02*** | (2006.01) |
| ***F21L 4/04*** | (2006.01) |
| ***F21V 5/04*** | (2006.01) |
| ***F21V 14/02*** | (2006.01) |
| ***F21V 21/30*** | (2006.01) |
| ***F21Y 115/10*** | (2016.01) |

(52) U.S. Cl.
CPC ..... *F21V 14/025* (2013.01); *F21L 4/045* (2013.01); *F21V 21/30* (2013.01)

(58) Field of Classification Search
None
See application file for complete search history.

(56) References Cited

U.S. PATENT DOCUMENTS

2011/0063824 A1* 3/2011 Qiu ..... F21L 4/027 362/188
2015/0029707 A1 1/2015 Cheng

FOREIGN PATENT DOCUMENTS

| | | | |
|---|---|---|---|
| CN | 203258391 | U | 10/2013 |
| CN | 103712077 | A | 4/2014 |
| CN | 203810068 | U | 9/2014 |
| CN | 203868953 | U | 10/2014 |
| CN | 205896774 | U | 1/2017 |

* cited by examiner

*Primary Examiner* — Kristy A Haupt
(74) *Attorney, Agent, or Firm* — Leydig, Voit & Mayer, Ltd.

(57) ABSTRACT

A flashlight unit includes a housing having an opening including a lens and a light source located in the housing for emitting light through the lens in a lighting direction. The light source is movable in the lighting direction, relative to the lens, for adjusting light emission. The flashlight unit has an adjusting mechanism including a rotatable member for adjusting the position of the light source in the lighting direction, relative to the lens. There is also a limiter for limiting rotational movement of the rotatable member when the light source reaches a predetermined position.

19 Claims, 8 Drawing Sheets

FLASHLIGHT UNIT

The present invention relates to a flashlight unit particularly, although not exclusively, the invention relates to a hand-held, battery-operated torch or flashlight that incorporates an adjusting mechanism and limiting means.

BACKGROUND OF THE INVENTION

Handheld flashlights with beam focusing feature have been known for years. The majority of such flashlights adopt a complex optical structure to provide its internal light source an adjusting mechanism within a confined space. The more complex the optical structure is, the more likely the components or parts associated with the adjusting mechanism would wear out under rough usage.

The invention seeks to eliminate or at least to mitigate such a shortcoming by providing a new or otherwise improved flashlight unit.

SUMMARY OF THE INVENTION

According to a first aspect of the invention, there is provided a flashlight unit comprising a housing having an opening provided with a lens, a light source provided in the housing for emitting light through the lens in a lighting direction, the light source being movable in the lighting direction relative to the lens for adjusting light emission, an adjusting mechanism including a rotatable member for adjusting the position of the light source in the lighting direction relative to the lens, limiting means for limiting rotational movement of the rotatable member upon the light source reaching a predetermined position, wherein the limiting means includes a stopper for limiting the rotation of the rotatable member; and wherein the rotatable member further includes a protrusion for abutting the stopper upon the light source reaching the predetermined position, thereby limiting further movement of the light source.

Preferably, the adjusting mechanism is adapted to move the light source in a reciprocal motion relative to the lens between first and second end positions for providing a variable lighting mode at different positions relative to the lens.

It is further preferred that the stopper has a first side, against which the protrusion is to abut upon the rotatable member reaching furthermost in a first rotating direction, thereby limiting the light source against moving further towards the lens.

It is yet further preferred that the stopper includes a second side opposite to the first side, against which the protrusion is to abut upon the rotatable member reaching furthermost in a second, opposite rotating direction, thereby limiting the light source against moving further away from the lens.

In a preferred embodiment, the protrusion extends circumferentially along the rotatable member to form an arcuate member.

In a more preferred embodiment, the limiting means includes a recess extending between the first side and the second side of the stopper for receiving the protrusion.

Preferably, the flashlight unit further including a light source holder for holding the light source.

More preferably, the adjusting mechanism includes positioning means for adjusting the position of the light source holder along the rotation axis of the rotatable member.

Furthermore preferably, the adjusting mechanism includes a guiding member for guiding axial movement of the light source holder.

Yet furthermore preferably, the light source holder includes a plurality of flanges.

Yet furthermore preferably, the plurality of flanges form a recess, against which the guiding member is to abut, thereby limiting the light source holder against rotating along the rotation axis of the rotatable member.

It is preferred that the flashlight unit further includes spring-loaded means acting between the rotatable member and the housing to provide a clicking engagement therebetween.

Preferably, the flashlight unit further including a handle rotatably coupled to one end of the housing opposite to the opening provided with the lens.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Referring initially to FIGS. 1 to 8 of the drawings, there is shown a flashlight unit 100 embodying the invention, which is intended for use primarily in outdoor or indoor. The flashlight unit 100 has a housing 3 having an opening provided with a lens 5, a light source 7 provided in the housing 3 for emitting light through the lens 5 in a lighting direction. The light source 7 is movable in the lighting direction relative to the lens 5 for adjusting light emission.

Figure 1:
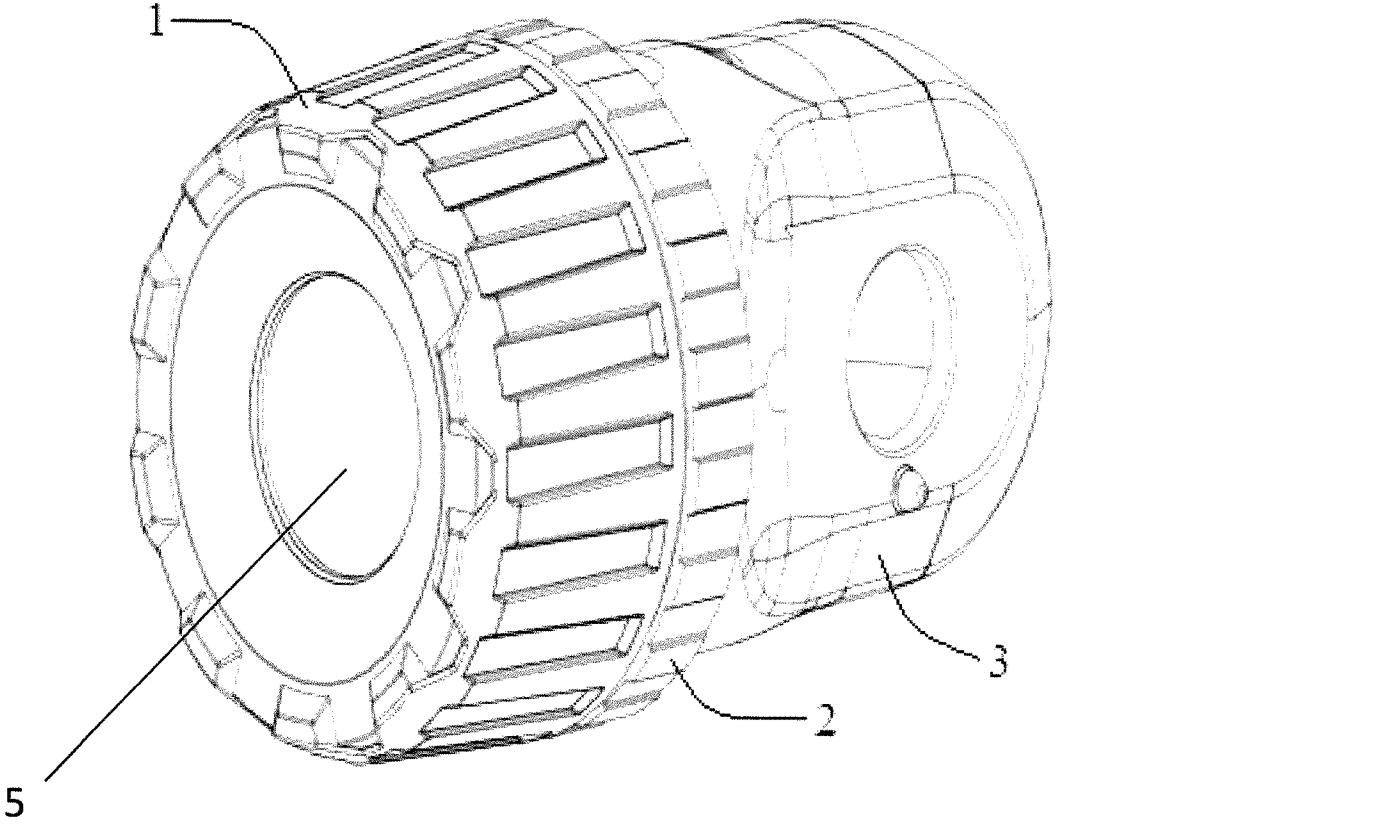
FIG. 1 is a perspective view of an embodiment of a flashlight unit in accordance with the invention.
Figure 2:
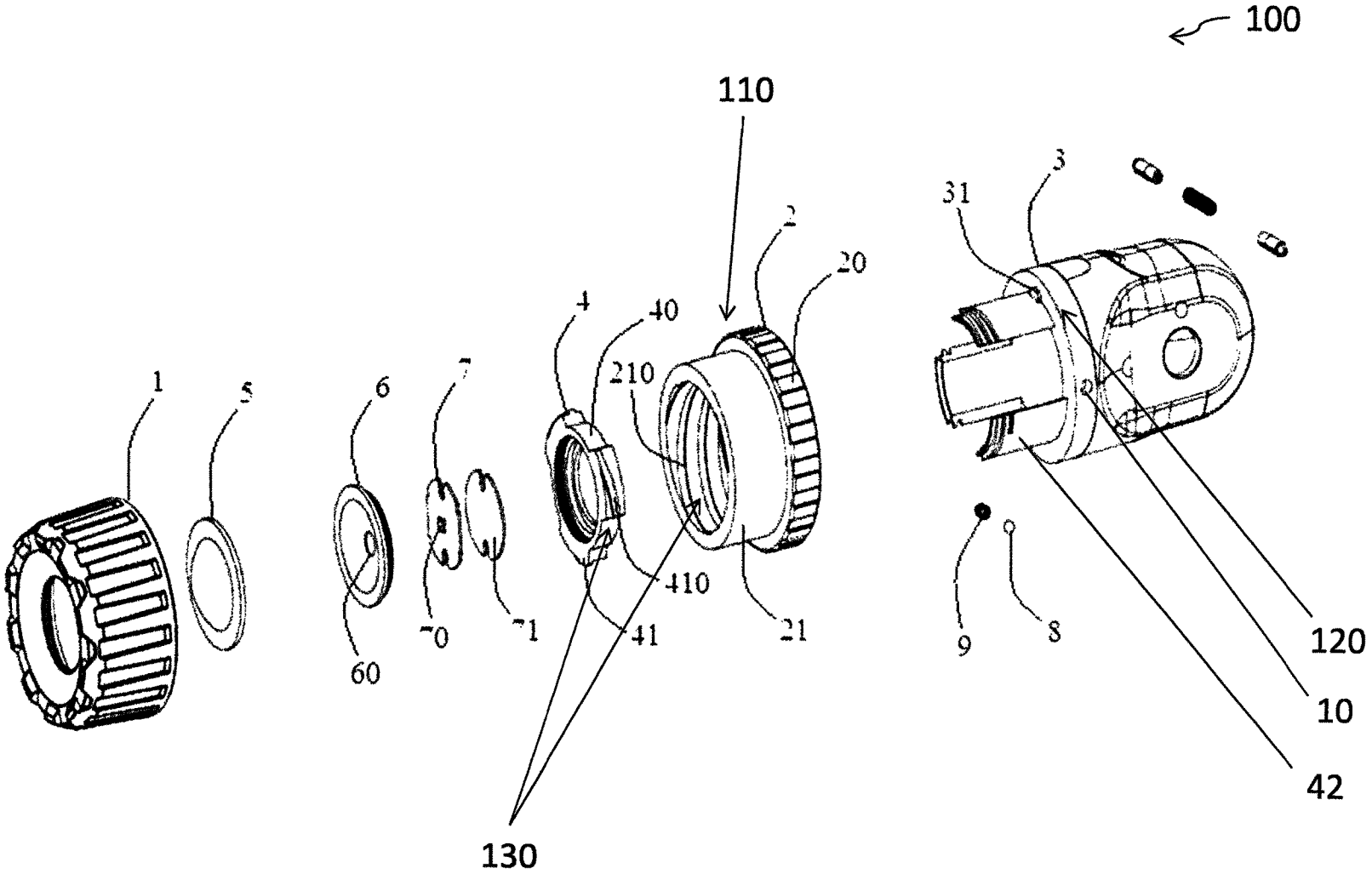
FIG. 2 is an explosive view of the flashlight unit of FIG. 1.
Figure 3:
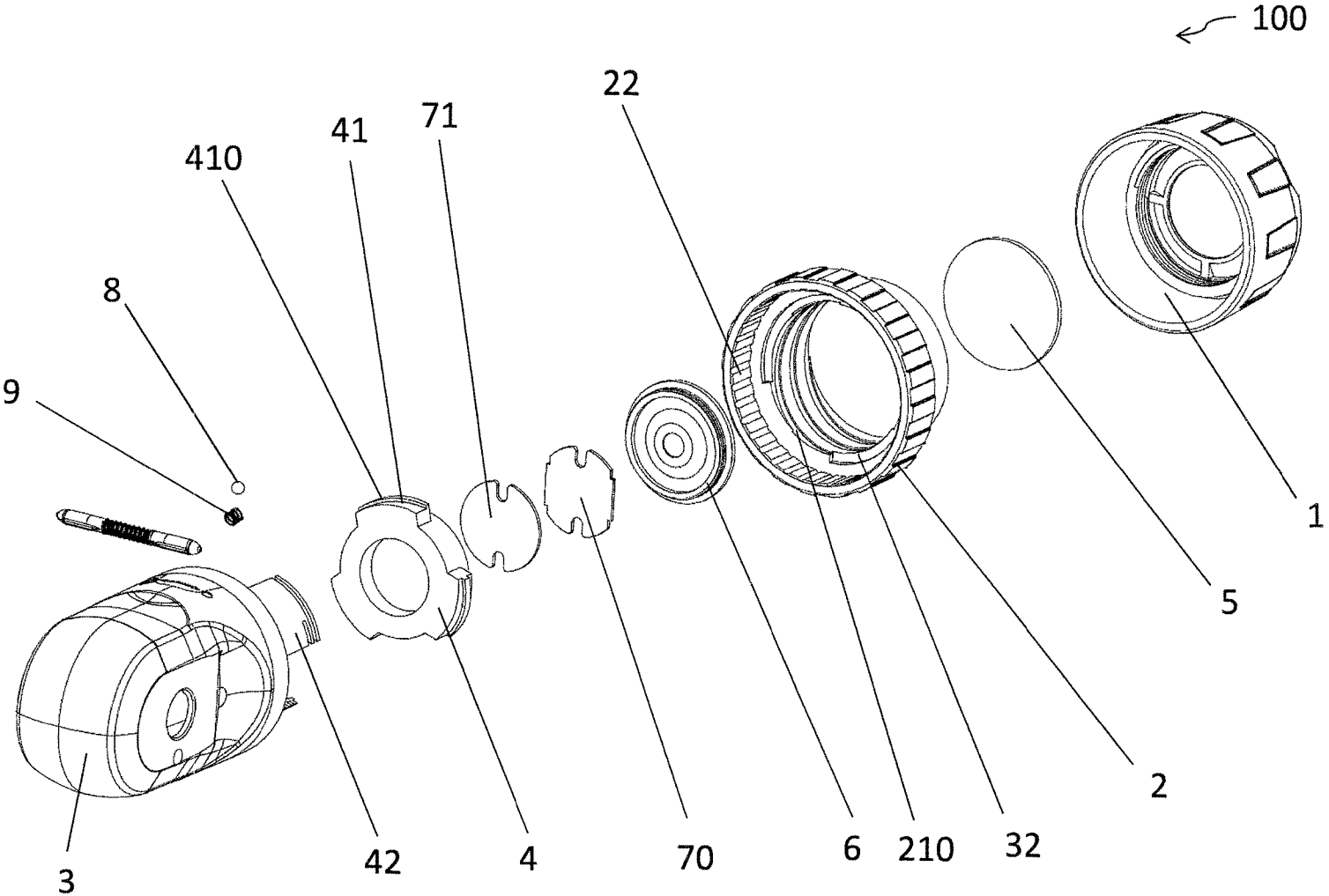
FIG. 3 is another explosive view of the flashlight unit of FIG. 1.

More specifically, there are depicted in the exploded illustrations of FIGS. 2 and 3 the components of the flashlight unit 100. These components include the housing 3, an opening at one end of the housing 3, the lens 5 and a bezel 1 typically formed of plastics material into which the lens 5 is mounted.

A light source holder 4 holds the light source 7 and a reflector 6 positioned therein. The light source 7 includes a LED 70 and a pad 71 that supports the LED 70. The adjacent reflector 6 includes an aperture 60, through which the LED 70 is exposed. Whilst the majority of the light beam passes straight through the aperture 60 of the reflector 6 towards the lens 5, the laterally-emitting part of the light beam initially falls onto the reflector 6, hence received thereby. The received light beam is then reflected off the concave inner surface of the reflector 6 and directed towards the lens 5. The light source 7 is preferably arranged to be movable in a reciprocal motion relative to the lens 5 between first and second end positions for providing a variable lighting mode at different positions relative to the lens 5.

Figure 4:
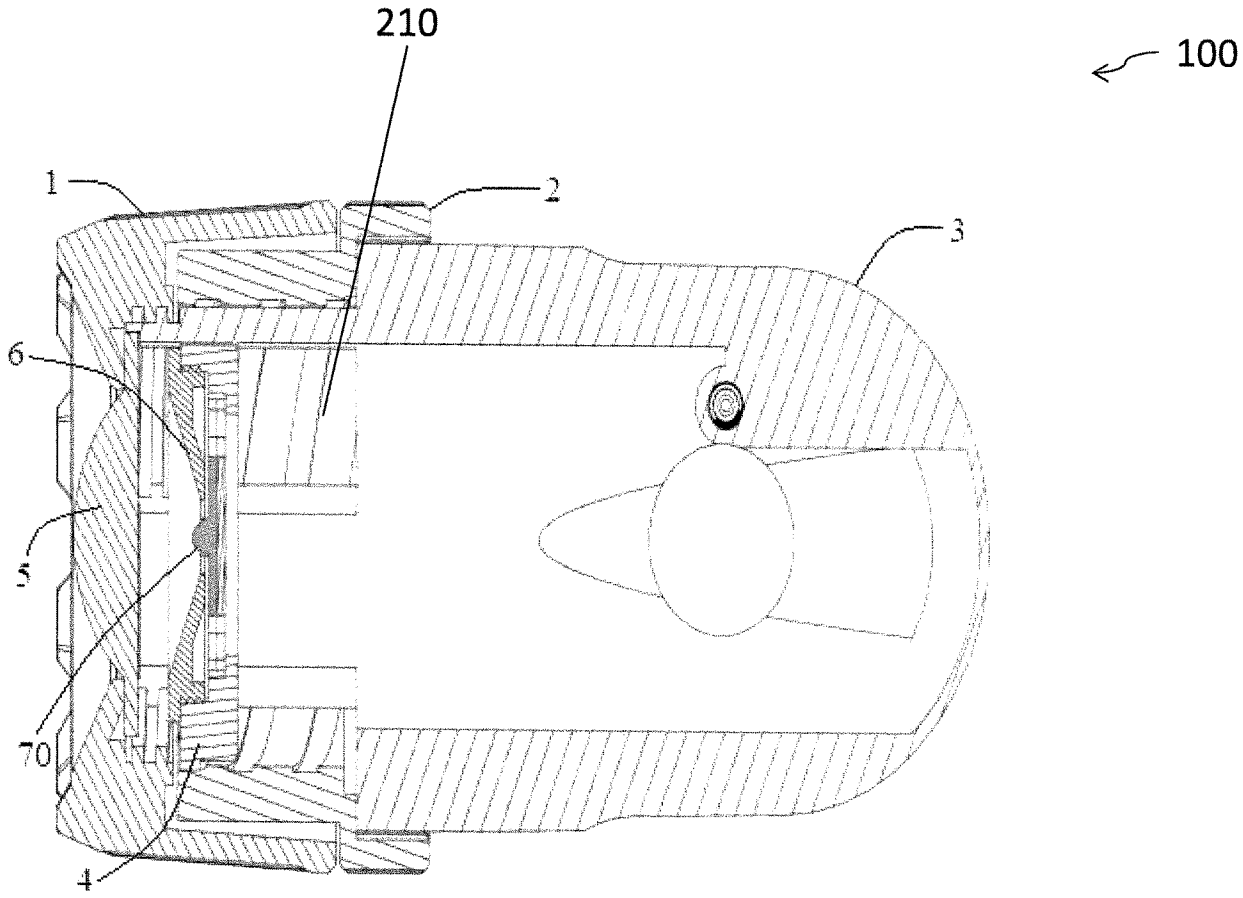
FIG. 4 is a cross-sectional view illustrating the flashlight unit of FIG. 1 is operated in a first lighting mode.
Figure 5:
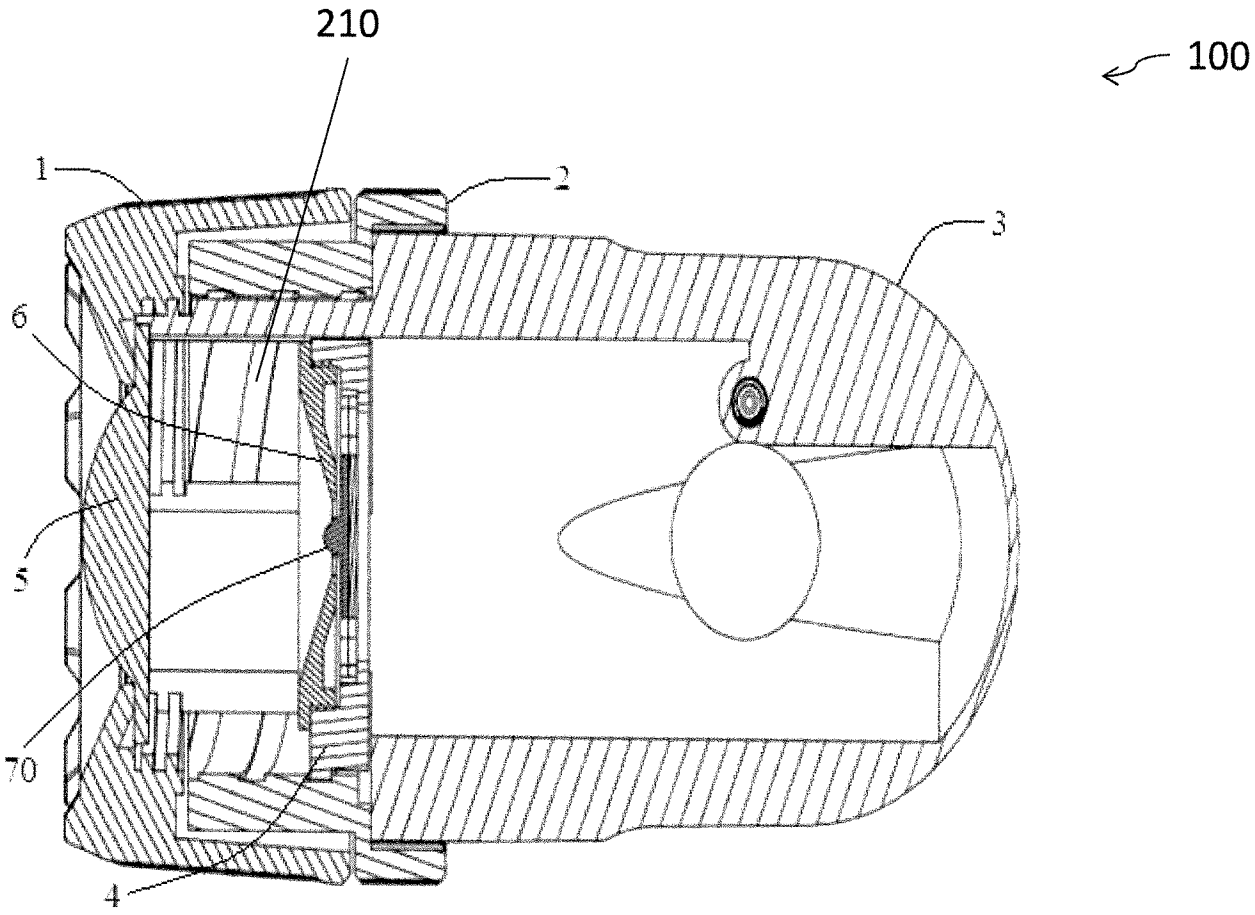
FIG. 5 is a cross-sectional view illustrating the flashlight unit of FIG. 1 is operated in a second lighting mode.
Figure 6:
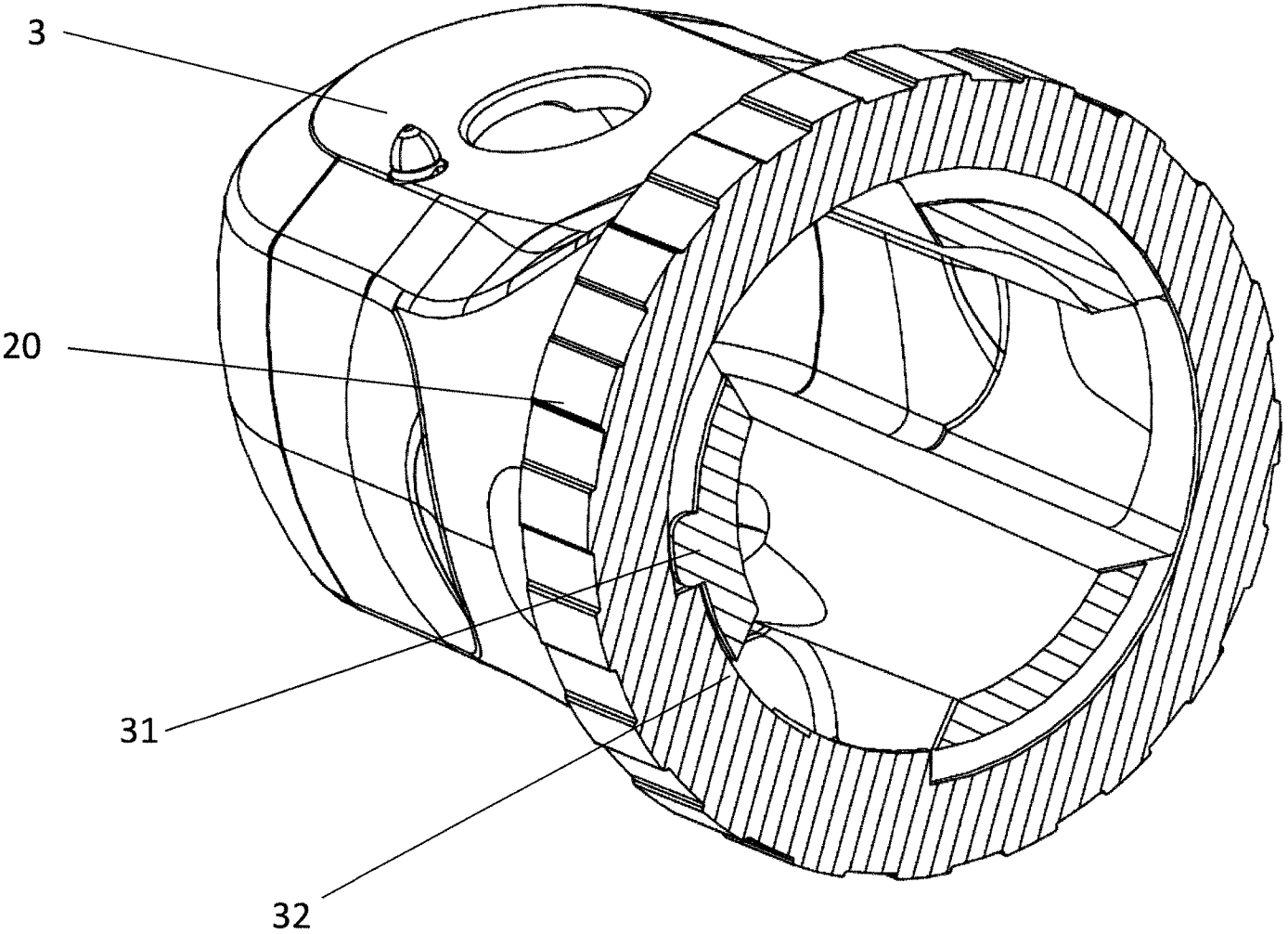
FIG. 6 is a cross-sectional perspective view of the flashlight unit of FIG. 4, showing some internal features of the flashlight unit when operated in the first lighting mode.
Figure 7:
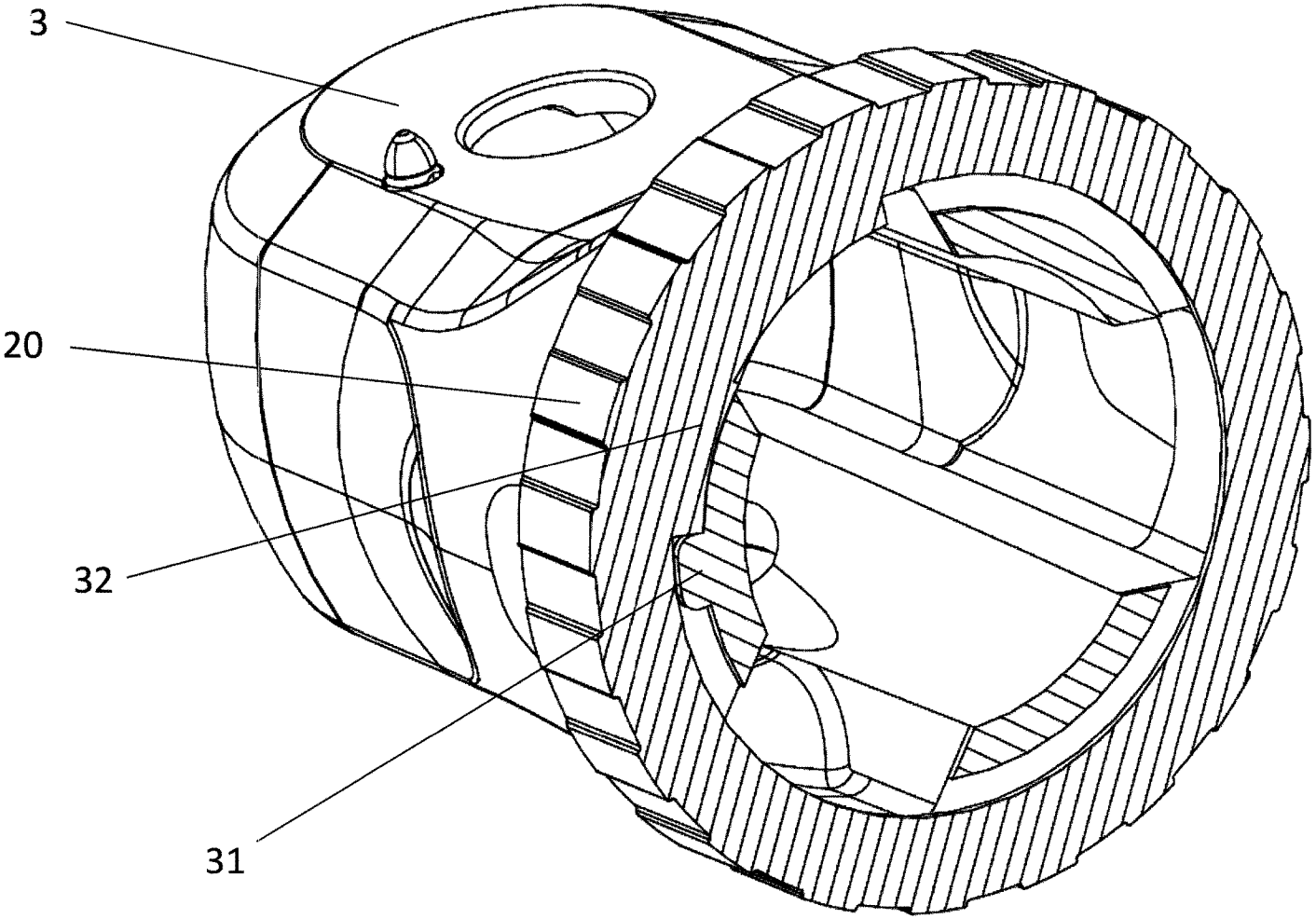
FIG. 7 is a cross-sectional perspective view of the flashlight unit of FIG. 5, showing some internal features of the flashlight unit when operated in the second lighting mode.
Figure 8:
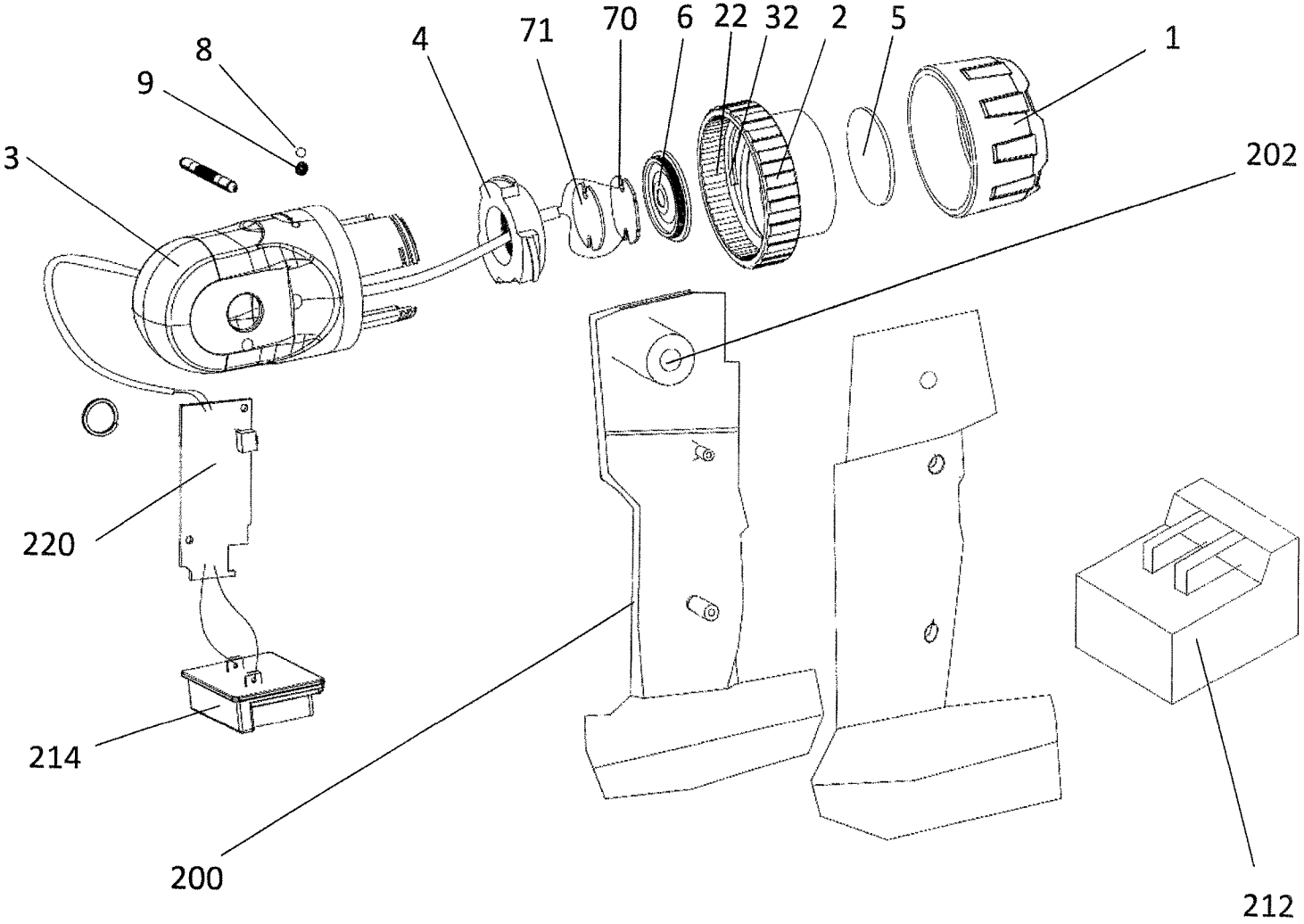
FIG. 8 is a perspective view of another embodiment of a flashlight unit in accordance with the invention.

In more detail, the lens 5 is preferably a convex lens, and more preferably a plano-convex lens, for refracting the light passing therethrough in a more focused or converging manner. In one particular embodiment, the light source 7 may be positioned at a first position proximate to the lens 5 for providing a broadened light beam in a floodlight mode, as shown in FIGS. 4 and 6. On the other hand, the light source 7 may be positioned at a second position furthermost from the lens 5 for providing a narrowed light beam in a focused mode, as shown in FIGS. 5 and 7. In a different embodiment, the lens 5 may be a concave lens for refracting the light passing therethrough in a more dispersed manner.

The flashlight unit 100 further includes an adjusting mechanism 110 for adjusting the position of the light source 7 in the lighting direction, relative to the lens 5. In one particular embodiment, the adjusting mechanism 110 includes a rotatable member 2 having an exposed dial portion 20 accessible by a user and an inner portion 21 for receiving the light source holder 4. The inner portion 21 may be snap fitted to the bezel 1.

The rotatable member 2 may be rotated in a first rotating direction or in the opposite, second rotating direction along its rotation axis, independent of any linear movements, for adjusting the position of the light source 4 in a reciprocal movement. For instance, the rotatable member 2 may be rotated in a first rotating direction e.g. a clockwise direction to move the light source 7 towards the lens 5 for operation in the floodlight mode. Similarly, the rotatable member 2 may be rotated in a second rotating direction e.g. an anti-clockwise direction to move the light source 7 away from the lens 5 for illumination in the focused mode.

The flashlight unit 100 also includes limiting means 120 for limiting the rotational movement of the rotatable member 2 upon the light source 7 reaching a predetermined position. In one particular embodiment, the rotatable member 2 may be a hollow or ring shaped, i.e. annular, member that surrounds part of the housing 3 and further includes, at an inner perimeter, an internal protrusion 32 that extends circumferentially along only part of the inner perimeter of the annular rotatable member 2. The limiting means 120 may include a stopper 31 located on the housing 3, as shown in FIGS. 1-8, at a position along the rotation path of the protrusion 32, limiting the rotation of the rotatable member 2 within a predetermined range.

The stopper 31 includes a first side and a second side, which is opposite the first side, together. The part of the inner perimeter of the rotatable member 2 where the protrusion 32 is not present defines a curved, i.e., arcuate, recess receiving the stopper 31. The protrusion 32 may extend circumferentially along only part of the rotatable member 2 to form an arcuate member. In general, the recess is sized to allow rotation of the annular rotatable member 2 about its rotation axis. The stopper 31 may abut the protrusion 32 upon the light source 7 reaching the predetermined positions in each direction, i.e., the first and second end positions.

In one particular embodiment, the protrusion 32 abuts the first side of the stopper 31 upon the rotatable member 2 reaching furthermost in a first rotating direction, thereby limiting the light source 7 against moving further towards the lens 5. On the other hand, the protrusion 32 abuts the opposite, second side of the stopper 31 upon the rotatable member 2 reaching furthermost in a second, opposite rotating direction, thereby limiting the light source 7 against moving further away from the lens 5.

The adjusting mechanism 110 further includes positioning means 130 for adjusting the position of the light source 7, via the light source holder 4, along the rotation axis of the rotatable member 2. In one particular embodiment, the positioning means 130 may be provided as a pair of complementary threads on the rotatable member 2 and the light source holder 4. For instance, the inner portion 21 of the rotatable member 2 may include an internal thread 210 that engages with an external thread 410 of the light source holder 4.

Upon the rotatable member 2 being rotated in a first direction, the external thread 410 of the light source holder 4 is pushed by the internal thread 210 to move towards the lens 5, thereby operating the flashlight 100 in the floodlight mode. When the rotatable member 2 is rotated in a second, opposite direction, the external thread 410 of the light source holder 4 is pushed by the internal thread 210 to move away from the lens 5, thereby operating the flashlight 100 in the focused mode. The rotatable member 2 remains lying in an imaginary plane perpendicular to its rotation axis throughout the operation. The presence of the limiting means 120 serves to prevent, or to at least minimize, screw stripping between the external thread 410 and the internal thread 210 upon the external thread 410 engaging the internal thread 210 at the two extreme positions.

In more detail, the light source holder 4 may include a plurality of flanges 41, and preferably three flanges 41, extending from the outer periphery of the light source holder 4. The flanges 41 preferably protrude radially about the outer periphery of the light source holder 4 in an equidistant manner to form a plurality of recesses therebetween. For instance, each of the three flanges 41 may be spaced apart from the other at an angle of 120°.

A plurality of guiding members 42 is also provided by the adjusting mechanism 110 for guiding axial movement of the light source holder 4, i.e. restricting the light source holder 4 against rotation. The guiding members 42 may be extended longitudinally from the housing 3 towards the light source holder 4 through the rotatable member 2.

Each guiding member 42 abuts the aforesaid recess on the light source holder 4, thereby restricting the light source holder 4 against rotation about the rotation axis of the rotatable member 2 when the flashlight unit 100 is switched between the two lighting modes.

The light source holder 4 should be readily movable between the first and second positions without rotating the rotatable member 2 for a full turn. In one particular embodiment, the screw pitch of the inner thread 210 may preferably be 15 mm to 30 mm. The light source holder 4 may be moved from a furthermost position relative to the lens 5 to a position adjacent to the lens 5, and vice versa by rotating the rotatable member 2 for substantially less than 270 degrees. This provides a compact adjusting mechanism 110 and ensures that the size of the flashlight unit 100 would not be traded off for accommodating the adjusting mechanism 110.

In a preferred embodiment, the flashlight unit 100 includes, as part of the adjusting mechanism 110, spring-loaded means acting between the rotatable member 2 and the housing 3 to provide a clicking engagement between them. The clicking engagement is provided by a steel ball 8, resilient means in the form of a coil spring 9 acting upon the steel ball 8. A hole 10 in the housing 3 receives the steel ball 8 and the spring 9 acting on the steel ball 8 so that the spring-loaded means is mounted in the housing 3.

The housing 3 has a front end surrounded by the exposed dial portion 20 of the rotatable member 2. The hole 10 is formed at the front end of the housing 3 at where the front end is covered by the dial portion 20 of the rotatable member 2, such that the steel ball 8 is urged by the spring 9 against the inner surface of the dial portion 20.

On and extending axially along its inner surface, the dial portion 20 includes a ring of serrations 22 in alignment with and for clicking engagement by the spring-loaded steel ball 8. Upon rotation of the rotatable member 2, the serrations 22 on its inner surface repeatedly actuate, i.e., move the steel ball 8 and compress and extend the coil spring 9 to click past the serrations 22, i.e., across the inner surface of the dial portion 20, thereby generating a clicking sound with a tactile feedback for the user.

The flashlight unit 100 includes a handle 200 (only depicted in FIG. 8) which is provided at and connected to the rear end of the housing 3 opposite to the aforesaid end with an opening fitted with the lens 5. The housing 3 has a rear part rotatably coupled to an upper part of the handle 200 through a hinge joint 202, thereby allowing the user to adjust the angle of the housing 3 relative to the handle 200 and hence the direction of illumination when the flashlight unit 100 is in use.

Within the handle 200, there is to be housed one or more battery packs 212, a battery terminal 214, a control circuit 220 and a power switch (not shown). These components are electrically connected to the light source 7 by means of cables. In more detail, the cables extend from the light source 7 through the aperture of the light source holder 4 to reach the control circuit 220, with the battery packs 212 being connected to the control circuit 220 through the battery terminal 214 from a position within the handle 200.

The invention has been given by way of example only, and various other modifications of and/or alterations to the described embodiment may be made by persons skilled in the art without departing from the scope of the invention as specified in the appended claims.

The invention claimed is:

1. A flashlight unit comprising:

a housing having an opening;

a lens located in the opening of the housing;

a light source located in the housing for emitting light through the lens in a lighting direction, wherein the light source is movable in the lighting direction, relative to the lens, between first and second end positions, for adjusting light emission from the flashlight unit;

an adjusting mechanism including an annular rotatable adjusting member that is externally exposed and surrounds part of the housing, wherein the annular rotatable adjusting member rotates about a rotation axis to adjust position of the light source in the lighting direction, relative to the lens, and the rotation axis of the annular rotatable adjusting member is parallel to the lighting direction of the light source; and limiting means for limiting rotational movement of the annular rotatable adjusting member when the light source reaches the first end position and the second end position, and including a stopper located on the housing for limiting the rotation of the annular rotatable adjusting member and having first and second opposed sides, and an internal protrusion on only part of an inner perimeter of the annular rotatable adjusting member and rotating with the annular rotatable adjusting member along a rotation path, wherein the rotation path is positioned about an axis that is parallel to the rotation axis, and the stopper is positioned along the rotation path so that a respective one of the first and second sides of the stopper abuts the protrusion when the light source reaches the first end position and the second end position, respectively, limiting further movement of the light source along the lighting direction.

2. The flashlight unit according to claim 1, wherein the first side of the stopper abuts the protrusion when the annular rotatable adjusting member reaches furthermost in a first rotating direction, preventing the light source from moving further towards the lens.

3. The flashlight unit according to claim 2, wherein the second side of the stopper abuts the protrusions when the annular rotatable adjusting member reaches furthermost in a second rotating direction, opposite the first rotating direction, preventing the light source from moving further away from the lens.

4. The flashlight unit according to claim 1, wherein the protrusion is an arcuate member.

5. The flashlight unit according to claim 1, further including a light source holder located in the housing and holding the light source.

6. The flashlight unit according to claim 5, further including positioning means for adjusting position of the light source holder along the rotation axis of the annular rotatable adjusting member.

7. The flashlight unit according to claim 6, wherein the positioning means includes an external thread on the light source holder and an internal thread on and inside the annular rotatable adjusting member and threadedly engaged with the external thread so that rotation of the annular rotatable adjusting member moves the light source holder, and the light source is moved between the first end position and the second end position by rotation of the annular rotatable adjusting member through less than one complete rotation of the annular rotatable adjusting member.

8. The flashlight unit according to claim 1, wherein the annular rotatable adjusting member has a circumferential inner surface, and the adjusting mechanism includes spring-loaded means mounted in the housing and acting against the circumferential inner surface of the annular rotatable adjusting member.

9. The flashlight unit according to claim 8, wherein rotation of the annular rotatable adjusting member is biased by a biasing force applied by the spring-loaded means to the circumferential inner surface of the annular rotatable adjusting member.

10. The flashlight unit according to claim 8, wherein the spring-loaded means comprises a ball and a coil spring mounted in the housing, with the ball protruding from the housing, and the coil spring acts upon the ball to act against the circumferential inner surface of the annular rotatable adjusting member.

11. The flashlight unit according to claim 10, wherein the circumferential inner surface of the annular rotatable adjusting member is adapted for repeated actuation of the ball and coil spring as the ball passes across the circumferential inner surface during rotation of the rotatable adjusting member.

12. The flashlight unit according to claim 11, wherein the repeated actuation of the ball and coil spring passing across the circumferential inner surface generates clicking sounds.

13. The flashlight unit according to claim 11, wherein the circumferential inner surface includes a plurality of serrations repeatedly actuating the ball and coil spring as the ball passes across the serrations during rotation of the annular rotatable adjusting member.

14. The flashlight unit according to claim 1, further including a handle rotatably coupled to an end of the housing, opposite the opening and the lens.

15. The flashlight unit according to claim 1, wherein the protrusion defines ends of an arcuate recess receiving the stopper, and the stopper, within the arcuate recess, moves relative to the annular rotatable adjusting member, along the rotation path, as the annular rotatable adjusting member is rotated.

16. The flashlight unit according to claim 15, wherein the protrusion and the arcuate recess circumferentially extend along respective parts of the inner perimeter.

17. The flashlight unit according to claim 6, wherein the positioning means includes a guiding member on the housing, extending through the annular rotatable adjusting member, engaging the light source holder, and guiding axial movement of the light source holder along the lighting direction.

18. The flashlight unit according to claim 17, wherein the light source holder includes a plurality of flanges.

19. The flashlight unit according to claim 18, wherein the plurality of flanges form a recess which the guiding member abuts, preventing the light source holder from rotating about the rotation axis of the annular rotatable adjusting member.

* * * * *